US007348950B2

(12) United States Patent
Halfant

(10) Patent No.: US 7,348,950 B2
(45) Date of Patent: Mar. 25, 2008

(54) DYNAMICAL SYSTEMS APPROACH TO LCD OVERDRIVE

(75) Inventor: Matthew Halfant, San Jose, CA (US)

(73) Assignee: Genesis Microchip Inc., Santa Clara, CA (US)

( * ) Notice: Subject to any disclaimer, the term of this patent is extended or adjusted under 35 U.S.C. 154(b) by 582 days.

(21) Appl. No.: 10/985,688

(22) Filed: Nov. 10, 2004

(65) Prior Publication Data

US 2005/0184941 A1 Aug. 25, 2005

Related U.S. Application Data

(60) Provisional application No. 60/546,608, filed on Feb. 20, 2004.

(51) Int. Cl.
*G09G 3/36* (2006.01)

(52) U.S. Cl. ..... 345/87

(58) Field of Classification Search ..... 345/87, 345/88, 89, 204
See application file for complete search history.

(56) References Cited

U.S. PATENT DOCUMENTS 6,930,663 B2 * 8/2005 Sekiya et al. ..... 345/87
2003/0137527 A1 * 7/2003 Lin et al. ..... 345/698
2003/0179175 A1 9/2003 Shigeta et al.

FOREIGN PATENT DOCUMENTS

WO WO2004/013835 2/2004

OTHER PUBLICATIONS

European Office Action dated Nov. 9, 2006 in corresponding EP Application No. 05250745.6.
Austrian Search and Exam Report dated Feb. 9, 2007 issued in corresponding Singapore Application No. 200500791-9.
Nakamura et al., "51.1: Overdrive Method for Reducing Response Times of Liquid Crystal Displays," SDI 01 Digest, vol. XXXII, May 1, 2001, p. 1256, XP007007778.
Lee, B. et al., "Late-News Paper: LCDS: How Fast is Enough," 2001 SID International Symposium Digest of Technical Papers, San Jose, CA, Jun. 5-7, 2001, vol. 32, Jun. 2001, pp. 1106-1109, XP001054118.

* cited by examiner

*Primary Examiner*—Amare Mengistu
*Assistant Examiner*—Grant D. Sitta
(74) *Attorney, Agent, or Firm*—Beyer Weaver LLP

(57) ABSTRACT

A method of overdriving LCD panels to improve LCD pixel response time is described that does not rely upon conventional use of overdrive look up tables. The method is based upon modeling the LCD pixels as linear second-order dynamical systems that leads to simple runtime calculations requiring but a small number of stored panel specific constants.

14 Claims, 3 Drawing Sheets

DYNAMICAL SYSTEMS APPROACH TO LCD OVERDRIVE

CROSS REFERENCE TO RELATED APPLICATIONS

The present application claims priority under 35 U.S.C. §119(e) from U.S. Provisional Patent Application No. 60/546,608 entitled "DYNAMICAL SYSTEMS APPROACH TO LCD OVERDRIVE" filed Feb. 20, 2004, the entire disclosure of which is incorporated herein by reference for all purposes.

BACKGROUND

1. Field of the Invention

The invention relates to display devices. More specifically, the invention describes a method and apparatus for enhancing the appearance of motion on an LCD panel display.

2. Overview

Each pixel of an LCD panel can be directed to assume a luminance value discretized to the standard set [0, 1, 2, . . . , 255] where a triplet of such pixels provides the R, G, and B components that make up an arbitrary color which is updated each frame time, typically $1/60^{th}$ of a second. The problem with LCD pixels is that they respond sluggishly to an input command in that the pixels arrive at their target values only after several frames have elapsed, and the resulting display artifacts—"ghost" images of rapidly moving objects—are disconcerting. Ghosting occurs when the response speed of the LCD is not fast enough to keep up with the frame rate. In this case, the transition from one pixel value to another cannot be attained within the desired frame time since LCDs rely on the ability of the liquid crystal to orient itself under the influence of an electric field. Therefore, since the liquid crystal must physically move in order to change intensity, the viscous nature of the liquid crystal material itself contributes to the appearance of ghosting artifacts.

In order to reduce and/or eliminate this deterioration in image quality, the LC response time is reduced by overdriving the pixel values such that a target pixel value (t) is reached, or almost reached, within a single frame period. In particular, by biasing the input voltage of a given pixel to an overdriven pixel value that exceeds the target pixel value for the current frame, the transition between the starting pixel value and target pixel value is accelerated in such a way that the pixel is driven to the target pixel value within the designated frame period. However, in order to efficiently calculate the overdrive pixel value, LCD overdrive table is commonly used that provides the appropriate overdrive pixel value that corresponds to a start, target pixel pair.

Although the LCD overdrive table is a standard and effective scheme often used in practice; this invention offers an alternative that reduces the ROM table storage requirements and offers a simplified runtime operation.

SUMMARY OF THE DISCLOSURE

In a liquid crystal display (LCD) panel having a number of LCD pixels, a method for providing a LCD pixel response time corresponding to a period of time required for a selected LCD pixel at a starting pixel value to reach a target pixel value.

Each of the LCD pixels is modeled as a second order dynamical system represented as a second order differential equation ($m\ddot{x}+k\dot{x}+x=p$) wherein x, $\dot{x}$, and p represent an LCD pixel strength, an LCD pixel velocity, and an applied LCD pixel command, respectively, and wherein m and k represent an LCD pixel mass and associated pixel damping factor, respectively. The LCD pixel response of the selected pixel under the influence of an imposed command p is calculated based upon the second order differential equation when the selected LCD pixel has an initial LCD pixel strength value of $x_0$ and an associated pixel velocity value of $v_0$.

In yet another embodiment, computer program product for providing a LCD pixel response time corresponding to a period of time required for a selected LCD pixel at a starting pixel value to reach a target pixel value associated with an overdrive pixel value in a liquid crystal display (LCD) panel having a number of LCD pixels is described. The computer program product includes computer code for modeling each of the LCD pixels as a second order dynamical system represented as a second order differential equation ($m\ddot{x}+k\dot{x}+x=p$) wherein x, $\dot{x}$ and p represent an LCD pixel strength, an associated pixel velocity, and an applied LCD pixel command, respectively, and wherein m and k represent an LCD pixel mass and associated pixel damping factor, respectively. The computer program product also includes computer code for calculating LCD pixel response data of the selected pixel under the influence of an imposed command p based upon the second order differential equation when the selected LCD pixel has an initial LCD pixel strength value of $x_0$ and an associated pixel velocity value of $v_0$, and computer readable medium for storing the computer code.

In still another embodiment, an apparatus coupled to a liquid crystal display (LCD) panel having a number of LCD pixels for providing an overdrive pixel value associated with a LCD pixel response time corresponding to a period of time required for a selected LCD pixel at a starting pixel value to reach a target pixel value is described. The apparatus includes an overdrive pixel value generator arranged to calculate a LCD pixel response data of a selected pixel under the influence of an imposed command p based upon a second order dynamical system model represented as a second order differential equation ($m\ddot{x}+k\dot{x}+x=p$) wherein x, $\dot{x}$ and p represent an LCD pixel strength, an associated pixel velocity, and an applied LCD pixel command, respectively, and wherein m and k represent an LCD pixel mass and associated pixel damping factor, respectively when the selected LCD pixel has an initial LCD pixel strength value of $x_0$ and an associated pixel velocity value of $v_0$.

DETAILED DESCRIPTION OF SELECTED EMBODIMENTS

Figure 1:
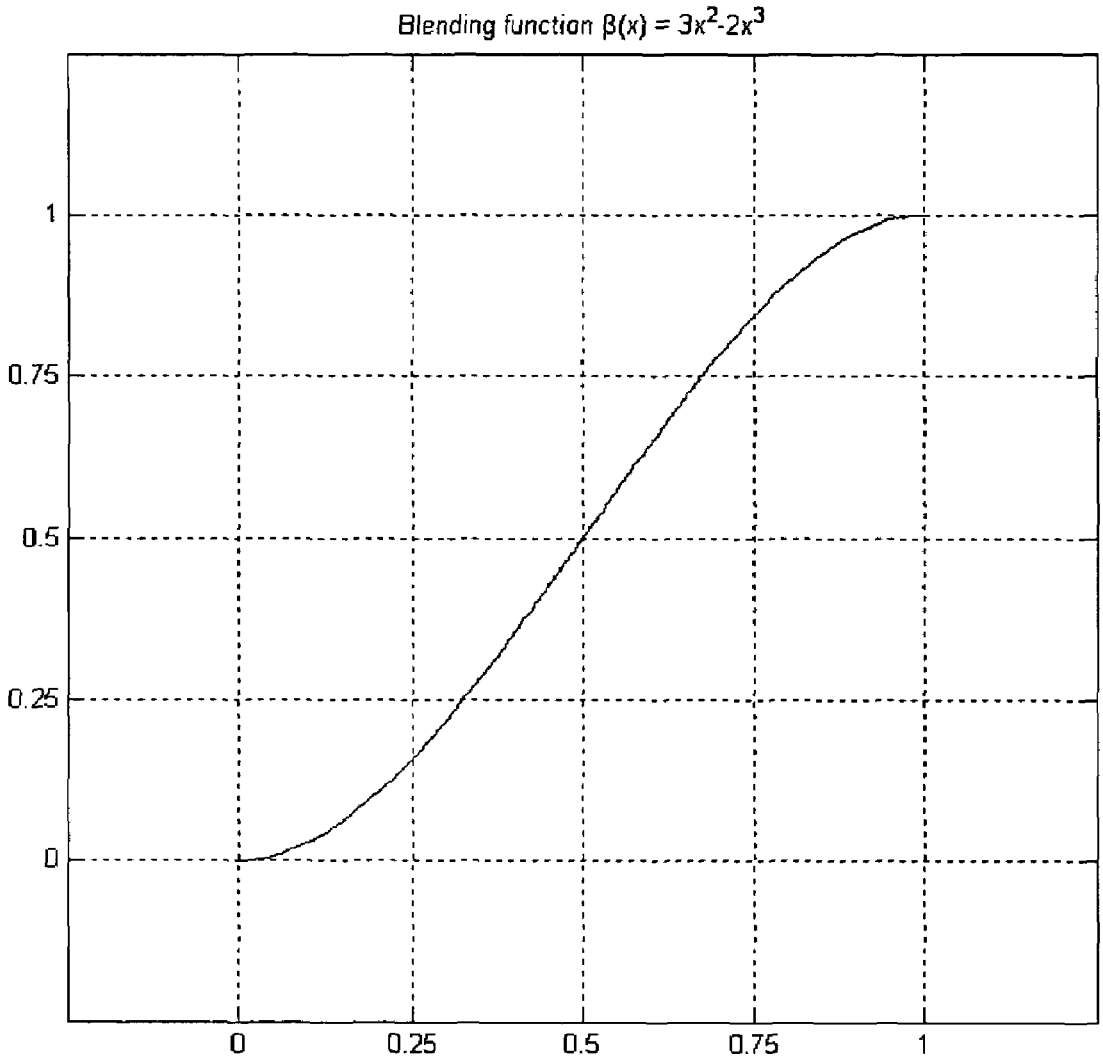
FIG. 1 shows a standard blending function (namely $\beta(x)=3x^2-2x^3$).

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

In order to improve the performance of slow LCD panels, the performance of the LCD panel is first characterized by, for example, taking a series of measurements that show what each pixel will do by the end of one frame time. Such measurements are taken for a representative pixel (or pixels) each being initially at a starting pixel value s that is then commanded toward a target value t (where s and t each take on integer values from 0 to 255). If the pixel value actually attained in one frame time is p, then $$p=f_s(t) \tag{1}$$

where $f_s$ is the one-frame pixel-response function corresponding to a fixed start-pixel s. For example, the one-frame pixel response function $f_s(t)$ for a pixel having a start pixel value s=32 and a target pixel value t=192 that can only reach a pixel value p=100 is represented as $f_{32}(192)=100$. For slow panels (where most if not all targets can not be reached within a frame time) maximum effort curves defined by functions $$\begin{cases} m(s) = f_s(0) \\ M(s) = f_s(255) \end{cases}$$

give the minimum pixel value and maximum pixel value, respectively, reachable in one frame time as functions of the start pixel s.

It should be noted that for the sake of simplicity, in the remainder of this discussion, any reference to an overdrive table refers to what is known in the art as a standard overdrive table having saturation regions $S_M$ and $S_m$ bounded by maximum effort curves M(s) and m(s), respectively. It is well to note, however, that any appropriate overdrive table, such as an extended overdrive table discussed in more detail in co-pending U.S. patent application Ser. No. 11/060,876 by Halfant that is incorporated by reference in its entirety for all purposes, is also well suited for use with the invention.

Therefore, in order to reach a pixel value p that lies within the interval [m(s), M(s)], equation (1) is solved for the argument t that produces pixel value p. The argument t is referred to as the overdrive pixel value that will achieve the goal (i.e., pixel value p) in one frame time. If p<m(s), then the overdrive pixel value is taken as having a best-effort value of 0, with m(s) being the best-effort result achieved. Likewise, if p>M(s) then the overdrive pixel is taken to be 255, with M(s) being the best-effort result. Thus, for a given start pixel s, overdrive function $g_s$ can be defined by equation 2 as $$g_s(p) = \begin{cases} 0, & p < m(s) \\ f_s^{-1}(p), & m(s) \le p \le M(s) \\ 255, & p > M(s) \end{cases} \tag{2}$$

In this way, the overdrive pixel value is effective in compelling the pixel to reach its target value in the non-saturation region and M(s) and m(s) in the saturation regions $S_M$ and $S_m$, respectively.

Instead of relying upon a static overdrive table, a dynamical systems approach offers a simple and efficient runtime procedure for estimating an overdrive pixel value that is based on the hypothesis that LCD pixels can be adequately described as second-order linear dynamical systems, or by several such approximations each acting within a sub-region of start-target space. The dynamical systems approach embraces the notion of state, which requires knowledge of intensity ("position") and velocity for second-order systems, and it shows how the state vector is methodically updated under the action of an imposed pixel force. The order is taken as 2, as shown in the differential equation (3)

$$m\ddot{x}+kv+x=p \tag{3}$$

where x represents the LCD pixel strength or pixel value, v represents the LCD pixel velocity or change of pixel value with respect to time $\dot{x}$ (which can be used interchangeably with the term v) and p is the applied pixel voltage which in one embodiment is constant throughout the frame time, and m and k are the mass and damping, respectively, where m represents the "inertia" or resistance that a pixel presents with respect to a change in its pixel value, much like mass in a dynamic system and the damping factor k represents an inherent nature of the LCD pixel (modeled as a dynamic system) that tends to reduce the amplitude of oscillations of that dynamic system. It should be noted that if p is held permanently fixed, then p=x in the steady-state where both $\ddot{x}$ and v, are 0.

The general solution of (3) can be written as the sum of any particular solution and the general solution of the associated homogeneous equation $$m\ddot{x}+k\dot{x}+x=0 \tag{4}$$

A particular solution of (3) is seen by inspection to be x=p. General solutions of (4) are found by substitution of the trial solution $x=e^{\alpha t}$ where $\alpha$ is a constant:

$$m\alpha^2e^{\alpha t}+k\alpha e^{\alpha t}+e^{\alpha t}=(m\alpha^2+k\alpha+1)e^{\alpha t}=0$$

Since $e^{\alpha t}$ never vanishes, then $\alpha$ must satisfy the quadratic equation $$m\alpha^2+k\alpha+1=0 \tag{5}$$

This admits of two roots:

$$\alpha_1 = \frac{-k+\sqrt{k^2-4m}}{2m}, \quad \alpha_2 = \frac{-k-\sqrt{k^2-4m}}{2m} \tag{6}$$

If $k^2-4m<0$ then the roots are complex and the system oscillates about its limiting value. In the case where the damping is high and the mass is small (thus, $k^2-4m>0$) both roots are real and in fact negative, $\alpha_1$ is only slightly negative it is referred to as the "slow root" and determines the system's settling rate whereas $\alpha_2$ is the "fast root" and influences the system's initial response behavior.

Given $\alpha_1$ and $\alpha_2$, the general solution to (3) can be written as $$x=c_1e^{\alpha_1 t}+c_2e^{\alpha_2 t}+p \tag{7}$$

where the constants $c_1$ and $c_2$ are chosen to fit the initial conditions on x and $\dot{x}$ at t=0. Differentiating (7) gives $$\dot{x}=c_1\alpha_1e^{\alpha_1 t}+c_2\alpha_2e^{\alpha_2 t}=v \tag{8}$$

(note: the symbol "v" is substituted hereinafter for $\dot{x}$ with regards to pixel velocity)

Letting $x_0=x(0)$ and $\dot{x}_0=\dot{x}(0)=v(0)=v_0$, and substituting t=0 into (7) and (8), gives the pair of equations:

$$\begin{cases} x_0 = c_1 + c_2 + p \\ v_0 = c_1\alpha_1 + c_2\alpha_2 \end{cases} \tag{9}$$

Solving for $c_1$ and $c_2$ yields $$c_1 = \frac{-v_0 + \alpha_2(x_0 - p)}{\alpha_2 - \alpha_1},\ c_2 = \frac{v_0 - \alpha_1(x_0 - p)}{\alpha_2 - \alpha_1} \tag{10}$$

This, in conjunction with (7) and (8), is a complete solution that predicts how a pixel, starting at a given value $x_0$ and velocity $v_0$, will evolve under the influence of an imposed command p. Choosing the frame time ($1/60^{th}$ second) as the unit of time, the effect at the end of the frame can be resolved by substituting t=1 into (7) and (8):

$$\begin{cases} x_1 = c_1e^{\alpha_1} + c_2e^{\alpha_2} + p \\ v_1 = c_1\alpha_1e^{\alpha_1} + c_2\alpha_2e^{\alpha_2} \end{cases} \tag{11}$$

where $c_1$ and $c_2$ are given by (10). In order to pass from each frame to the next, both x and v must be computed at each step and therefore without a knowledge of both these quantities at the beginning of a frame, the response to the command pixel p imposed during the frame can not be predicted. The constants $c_1$ and $c_2$ given in (10) incorporate runtime data (x, v, p) together with model data ($\alpha_1$, $\alpha_2$) and therefore cannot be stored in a ROM. Equation (11) is rewritten in a form that separates model and runtime variables:

$$\begin{cases} x_{n+1} = Ax_n + Bv_n + Cp \\ v_{n+1} = Dx_n + Ev_n + Fp \end{cases} \tag{12}$$

This shows the iterative nature going from frame n to n+1 (instead of simply from 0 to 1 as before). The runtime coefficients A, B, . . . , F depend on $\alpha_1$ and $\alpha_2$ (or equivalently, on m and k) and can be stored in a ROM. With m, k given, the roots $\alpha_1$, $\alpha_2$ are determined from equation (6). Substituting the coefficients $c_1$, $c_2$ from equation (10) into equation (11) and collecting terms in $x_0$, $v_0$, and p on the right, gives the expressions $$\begin{cases} x_1 = Ax_0 + Bv_0 + Cp \\ v_1 = Dx_0 + Ev_0 + Fp \end{cases}$$

where the runtime coefficients A, B, . . . , F are defined as:

$$\begin{cases} A = \dfrac{\alpha_2e^{\alpha_1} - \alpha_1e^{\alpha_2}}{\alpha_2 - \alpha_1} \\ B = \dfrac{-e^{\alpha_1} + e^{\alpha_2}}{\alpha_2 - \alpha_1} \\ C = \dfrac{-\alpha_2e^{\alpha_1} + \alpha_1e^{\alpha_2}}{\alpha_2 - \alpha_1} + 1 \\ D = \dfrac{\alpha_1\alpha_2}{\alpha_2 - \alpha_1}(e^{\alpha_1} - e^{\alpha_2}) \\ E = \dfrac{-\alpha_1e^{\alpha_1} + \alpha_2e^{\alpha_2}}{\alpha_2 - \alpha_1} \\ F = \dfrac{\alpha_1\alpha_2}{\alpha_2 - \alpha_1}(-e^{\alpha_1} + e^{\alpha_2}) \end{cases}$$

These are the same coefficients that enter equation (12), for they depend only on $\alpha_1$, $\alpha_2$ (or equivalently on m, k which determine them through (6)), and not on the iteration index—that is, going from 0 to 1 is the same as going from n to n+1.

During runtime, assume an initial "quiescent" state with $x_0$ and $v_0$ both 0 (i.e., steady black screen) and let $p_1$ be the pixel desired for frame 1, or in the general case that starts at frame n with known (or at least predicted) values $x_n$ and $v_n$, and that $p_{n+1}$ is the value that is wanted for frame n+1. That is, in (12) force $x_{n+1}=p_{n+1}$, which means what is required is a command pixel p that will force the first equation of (12) to take the form $p_{n+1}=Ax_n+Bv_n+Cp$. In this case, p is just the solution of this equation:

$$P_{ideal} = \frac{1}{C}(p_{n+1} - Ax_n - Bv_n) \tag{13}$$

(It should be noted that the reciprocal of the constant C is either stored in the ROM or computed once at init time, and is afterwards used as a multiplier.) Since the applied pixel command p must be an integer in the range 0 to 255, equation (13) is replaced with $$p = \text{round}\left(\text{Clamp}\left\{\frac{p_{n+1} - Ax_n - Bv_n}{C}, 0, 255\right\}\right) \tag{14}$$

where the Clamp notation has the meaning of clamping its first argument to the range 0 to 255 if necessary. This p is the overdrive pixel which is inserted into (12) to determine the resulting $x_{n+1}$ and $v_{n+1}$.

Given the hypothesis of a linear second-order dynamical system, the defining parameters m and k can be determined by any of a number of standard "system identification" techniques (such as Matlab's Identification Toolbox). Conceptually, numerous candidate pairs of m and k, taken together, are "tried" in the mathematical model, to see which pair of values causes to model to most-nearly match the measured pixel response data.

To illustrate the runtime operation, suppose that a particular panel has been characterized as being approximately a second-order linear dynamical system with m=0.5, k=2.0. Then the runtime coefficients A, B, . . . , F take on the values $$\begin{cases} A = 0.6551 \\ B = 0.1852 \\ C = 0.3349 \\ D = -0.3704 \\ E = -0.0756 \\ F = 0.3704 \end{cases}$$

Let's use $x_0=0$, $v_0=0$ to represent the initial pixel strength and velocity as appropriate for a video sequence starting with a steady black screen. Let's assume that the first non-black screen calls for the pixel $p_1$ to take the value 128:

$$p_1=128$$

We use equation (13) to find the ideal input pixel command, $p_{ideal}$, to achieve this result:

$$p_{ideal} = \frac{1}{C}(p_1 - Ax_o - Bv_0) = \frac{128}{0.3349} = 382.2$$

However, as shown in equation (14), this value must be clamped to 255, which is the largest applied pixel command we can issue:

$$p=\text{round}(\text{Clamp}(p_{ideal}, 0, 255))=255$$

This is the command input used in the equations (12) to compute the pixel and velocity values achieved at the end of the first frame:

$$\begin{cases} x_1 = Ax_0 + Bv_0 + Cp = 0 + 0 + 0.3349 \cdot 255 = 85.40 \\ v_1 = Dx_0 + Ev_0 + Fp = 0 + 0 + 0.3704 \cdot 255 = 94.45 \end{cases}$$

As we can see, due to the truncation of $P_{ideal}$ we have not come very close to our target pixel value of 128; but we will now use the value we did achieve—85.40—as the starting value for the next iteration. Let's say the required pixel value for the second frame is $p_2=137$. Using the values $x_1$ and $v_1$ just computed, we find the ideal pixel input command, from (13) to be:

$$\begin{aligned} p_{ideal} &= \frac{1}{C}(p_2 - Ax_1 - Bv_1) \\ &= \frac{1}{0.3349}(137 - 0.6551 \cdot 85.40 - 0.1852 \cdot 94.45) \\ &= 189.8 \end{aligned}$$

Since $p_{ideal}$ does not need to be clamped, we expect to get quite close to our goal of 137 using the rounded command p=190 back in the update equations (12):

$$\begin{cases} x_2 = Ax_1 + Bv_1 + Cp \\ \quad = 0.6651 \cdot 85.40 + 0.1852 \cdot 94.45 + 0.3349 \cdot 190 \\ \quad = 137.1 \\ v_2 = Dx_1 + Ev_1 + Fp \\ \quad = -0.3704 \cdot 85.40 - 0.0756 \cdot 94.45 + 0.3704 \cdot 190 \\ \quad = 31.60 \end{cases}$$

In the same manner, we may use the values $x_2$ and $v_2$ to compute the next overdrive pixel command, p, given any new required third-frame pixel, $p_3$.

The (m, k) pair value that best fits the entire panel may work better for some regions of the staff-target matrix than others. By best fit it is meant the values of m and k that when used in the dynamical model of the LCD pixel provides a corresponding LCD pixel response that most-nearly matches the measured LCD pixel response data for the LCD panel. Typically we can do better if we split the space of start-target pairs into sub-domains and devise separate approximations on each. One obvious separation is along the main diagonal (where start=target): on one side, start<target and we are in the domain of brightening operations; on the other, start<target and we are in the domain of dimming operations. Let's refer to these as domains D1 and D2, respectively.

The approximations $(m_1, k_1)$ and $(m_2, k_2)$ on each of these respective domains is a better approximation than that afforded by the original (m, k) which had to accommodate the full scope of start-target operations. We end up with two sets of runtime coefficients:

$$\begin{cases} D1\text{: } A_1, B_1, C_1, D_1, E_1, F_1 \\ D2\text{: } A_2, B_2, C_2, D_2, E_2, F_2 \end{cases}$$

This is easily applied at runtime: if the target pixel is greater than the start pixel, it's a brightening operation and we use the D1 coefficients; in the opposite case of a dimming operation, we use the D2 coefficients.

Further accuracy can be achieved by additional subdivisions of D1 and D2. For example, a panel brightening from the dark region (small start pixel values) may behave more sluggishly (larger m) than when starting from midrange or brighter regions. For illustration, let's use 32 as the separation point, and define two domains:

$$\begin{cases} D1a\text{: start pixel} < 32 \\ D1b\text{: start pixel} \geq 32 \end{cases}$$

These (sub-)domains will determine two parameter pairs, $(m_{1a}, k_{1a})$ and $(m_{1b}, k_{1b})$, respectively, each in turn with its own set of derived coefficients:

$$\begin{cases} D1a\text{: } A_{1a}, B_{1a}, C_{1a}, D_{1a}, E_{1a}, F_{1a} \\ D1b\text{: } A_{1b}, B_{1b}, C_{1b}, D_{1b}, E_{1b}, F_{1b} \end{cases}$$

But now there is a potential problem that didn't arise when working just with D1 and D2: visual artifacts may develop due to the sudden switching of coefficients when the start pixels cross the separation value of 32 (either spatially or temporally). This is a standard problem, and is handled by a technique known as blending.

To begin with, we define a transition region over which the blending will occur. In our example, let it span a region extending 5 pixel-values on either side of the separation point; that is, let it extend from $T_0=32-5=27$ to $T_1=32+5=37$. Thus the width of the transition region is 10, and it covers the interval (27, 37). The idea is that brightening operations with a start pixel≦27 will be handled with the D1a coefficients, those with a start pixel≧37 will be handled using the D2 coefficients, but those with a start pixel in the transition region will be handled with a blending of calculations using both sets of coefficients.

One simple approach uses transition coordinates that go from 0 to 1 on the transition region (which in our pixel coordinates goes from 27 to 37). Standard transition coordinates allow the use of standard blending functions such as ,$\beta(x)=3x^2-2x^3$, shown in the FIG. 1.

Assuming a brightening start-target pair with the start pixel, s, lying in the transition region—say, s=30. We'll start by computing the command pixel, p, and updated pixel, x, and velocity, v, using both D1a and D1b coefficients; let's suppose the results are $$\begin{cases} D1a\text{: } p_a = 231, \quad x_a = 131.4, \quad v_a = 78.63 \\ D1b\text{: } p_b = 192, \quad s_b = 130.7, \quad v_b = 105.6 \end{cases}$$

As to the blending of these results, we begin by converting s to the transition-coordinate equivalent:

$$t = \frac{s - T_0}{T_1 - T_0} = \frac{30 - 27}{37 - 27} = 0.3$$

Schematically, the blending will take the form $$(D1a)\cdot(\mathbf{1}-\beta(t))+(D1b)\cdot\beta(t)$$

and specifically, applying this to the command pixel gives:

$$\begin{aligned} p &= p_a \cdot (1 - \beta(t)) + p_b \cdot \beta(t) = 231 \cdot (1 - \beta(0.3)) + 192 \cdot \beta(0.3) \\ &= 231 \cdot 0.7840 + 192 \cdot 0.2160 = 222.576 \end{aligned}$$

which we would round to a command pixel=223; the same blending operation also gives us also the updated pixel value and velocity:

$$\begin{cases} x = x_a \cdot (1 - \beta(t)) + x_b \cdot \beta(t) = 131.4 \cdot 0.7840 + 130.7 \cdot 0.2160 = 131.2488 \\ v = v_a \cdot (1 - \beta(t)) + v_b \cdot \beta(t) = 78.63 \cdot 0.7840 + 105.6 \cdot 0.2160 = 84.4555 \end{cases}$$

Thus, the blended command pixel and update values are $$\begin{cases} p = 223 \\ x = 131.2488 \\ x = 84.4555 \end{cases}$$

Figure 2:
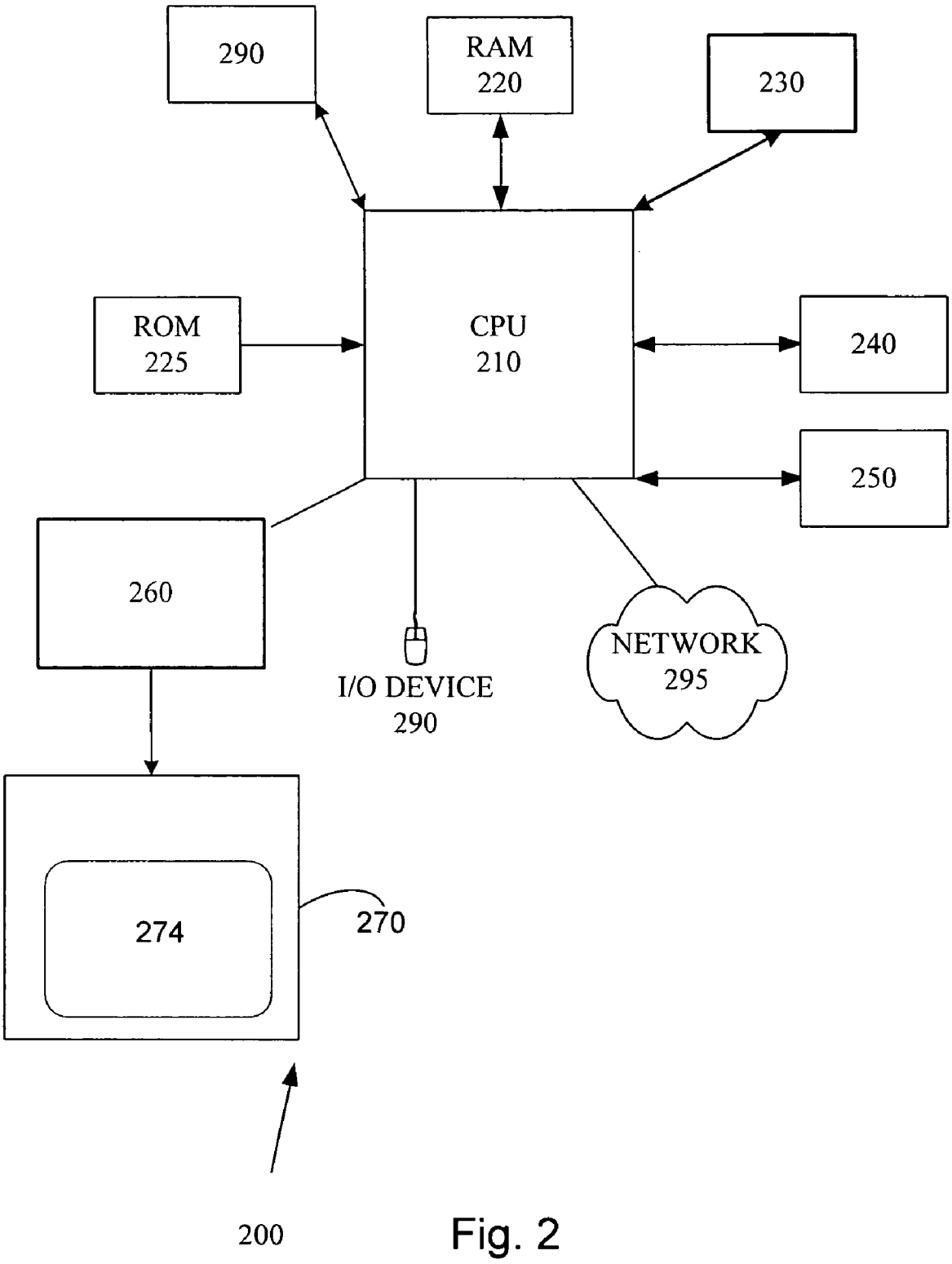
FIG. 2 illustrates a system employed to implement the invention.

FIG. 2 illustrates a system 200 employed to implement the invention. Computer system 200 is only an example of a graphics system in which the present invention can be implemented. System 200 includes central processing unit (CPU) 210, random access memory (RAM) 220, read only memory (ROM) 225, one or more peripherals 230, graphics controller 460, primary storage devices 240 and 250, and digital display unit 270. CPUs 210 are also coupled to one or more input/output devices 290. Graphics controller 260 generates image data and a corresponding reference signal, and provides both to digital display unit 270. The image data can be generated, for example, based on pixel data received from CPU 210 or from an external encode (not shown). In one embodiment, the image data is provided in RGB format and the reference signal includes the $V_{SYNC}$ and $H_{SYNC}$ signals well known in the art. However, it should be understood that the present invention can be implemented with image, data and/or reference signals in other formats.

Figure 3:
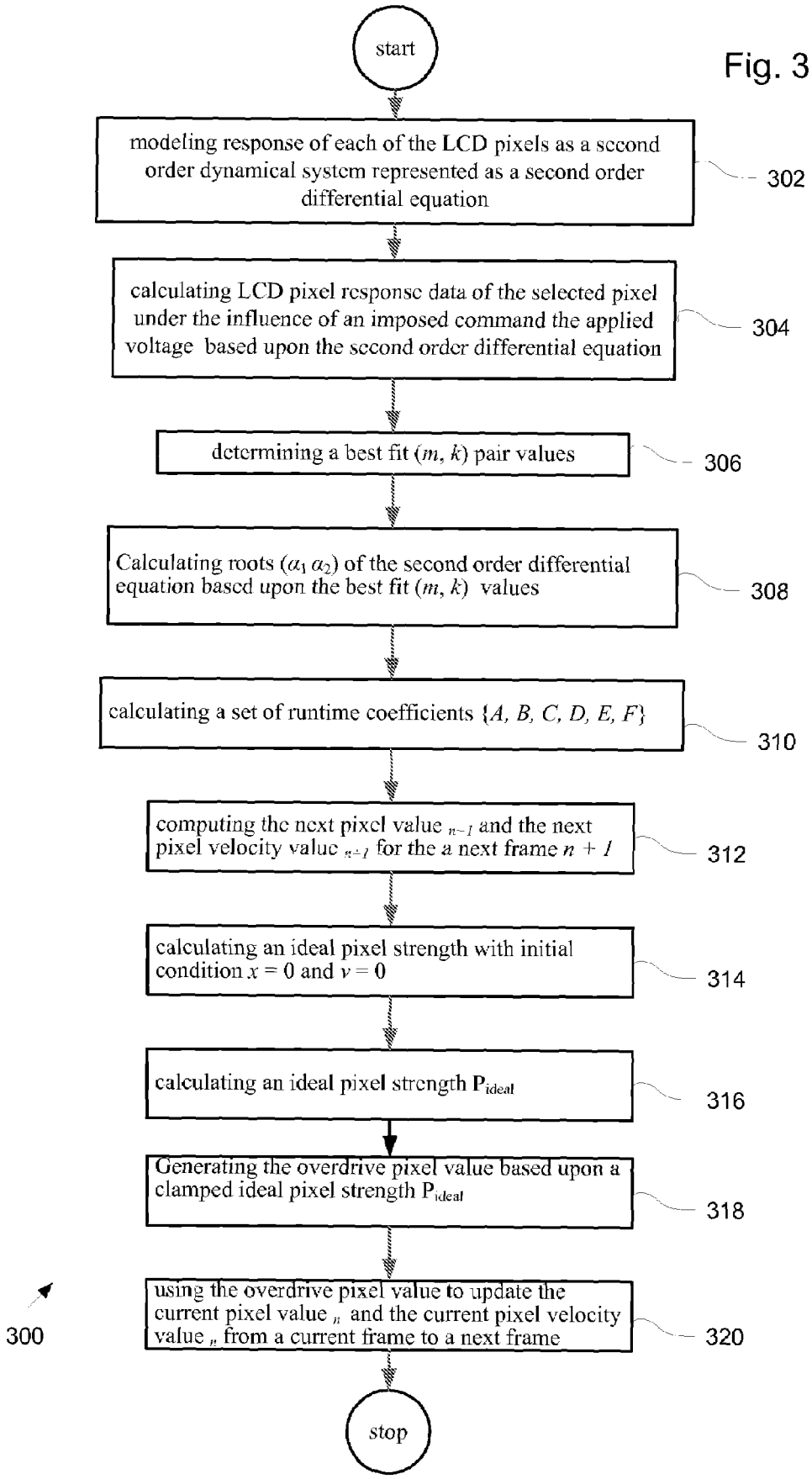
FIG. 3 illustrates a process in accordance with the invention.

FIG. 3 shows a flowchart detailing a process 300 in accordance with an embodiment of the invention. At 302, modeling response of each of the LCD pixels as a second order dynamicalsystem represented as a second order differential equation, at 304, calculating LCD pixel response data of the selected pixel under the influence of an imposed command the applied voltage based upon the second order differential equation, at 306, determining a best fit (m, k) pair values, at 308, Calculating roots $(\alpha_1\alpha_2)$ of the second order differential equation based upon the best fit (m, k) values, at 310 calculating a set of runtime coefficients {A, B, C, D, E, F}, at 312 computing the next pixel value$_{n+1}$ and the next pixel velocity value$_{n+1}$ for the a next frame n+1, at 314, calculating an ideal pixel strength with initial condition x=0 and v=0, at 316, calculating an ideal pixel strength $P_{ideal}$, at 318, Generating the overdrive pixel value based upon a clamped ideal pixel strength $P_{ideal}$, at 320, using the overdrive pixel value to update the current pixel value$_n$ and the current pixel velocity value$_n$ from a current frame to a next frame.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a particular embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

What is claimed is:

1. In a liquid crystal display (LCD) panel having a number of LCD pixels, a method for providing a LCD pixel response time corresponding to a period of time required for a selected LCD pixel at a starting pixel value to reach a target pixel value associated with an overdrive pixel value, comprising:

modeling response of each of the LCD pixels as a second order dynamical system represented as a second order differential equation ($m\ddot{x}+kv+x=p$) wherein x, v and p represent an LCD pixel value, an associated change in pixel value with respect to time, and an applied LCD pixel voltage, respectively, and wherein m and k represent an LCD pixel mass and associated pixel damping factor, respectively;

calculating LCD pixel response data of the selected pixel under the influence of the applied voltage p based upon the second order differential equation $m\ddot{x}+kv+x=p$ when the selected LCD pixel has an initial LCD pixel value of $x_0$ and an associated pixel velocity value of $v_0$;

determining a best fit (m, k) pair values, wherein the best fit (m,k) values are those values of m and k that result in a calculated LCD pixel response that most-nearly matches a measured LCD pixel response for the LCD panel; and calculating $\alpha_1$ and $\alpha_2$ based upon the best fit (m, k) pair values, wherein $$\alpha_1 = \frac{-k+\sqrt{k^2-4m}}{2m}, \alpha_2 = \frac{-k-\sqrt{k^2-4m}}{2m},$$

wherein $\alpha_1$ and $\alpha_2$ are roots of the second order differential equation $m\ddot{x}+kv+x=p$.

2. A method as recited in claim 1, further comprising:

calculating a set of runtime coefficients {A, B, C, D, E, F} as $$\begin{cases} A = \dfrac{\alpha_2 e^{\alpha_1} - \alpha_1 e^{\alpha_2}}{\alpha_2 - \alpha_1} \\ B = \dfrac{-e^{\alpha_1} + e^{\alpha_2}}{\alpha_2 - \alpha_1} \\ C = \dfrac{-\alpha_2 e^{\alpha_1} + \alpha_1 e^{\alpha_2}}{\alpha_2 - \alpha_1} + 1 \\ D = \dfrac{\alpha_1 \alpha_2}{\alpha_2 - \alpha_1}(e^{\alpha_1} - e^{\alpha_2}) \\ E = \dfrac{-\alpha_1 e^{\alpha_1} + \alpha_2 e^{\alpha_2}}{\alpha_2 - \alpha_1} \\ F = \dfrac{\alpha_1 \alpha_2}{\alpha_2 - \alpha_1}(-e^{\alpha_1} + e^{\alpha_2}) \end{cases}$$

wherein the runtime coefficients {A, B, C, D, E, F } are constants used to compute a next pixel value $x_{n+1}$ from a current pixel value $x_n$ and to compute a next pixel velocity value $v_{n+1}$ from a current pixel velocity value $v_n$.

3. A method as recited in claim 2, further comprising:

computing the next pixel value $x_{n+1}$ and the next pixel velocity value $v_{n+1}$ for a next frame n+1 wherein $$\begin{cases} x_{n+1} = Ax_n + Bv_n + Cp \\ v_{n+1} = Dx_n + Ev_n + Fp \end{cases}.$$

4. A method as recited in claim 3 comprising:

assuming an initial state with $x_0$ and $v_0$ both equal to 0.

5. A method as recited in claim 4 wherein based upon the assuming, calculating an ideal pixel strength $$p_{ideal} = \frac{1}{C}(p_{n+1} - Ax_n - Bv_n).$$

6. A method as recited in claim 5 comprising:

clamping the ideal pixel strength $$p_{ideal} = \frac{1}{C}(p_{n+1} - Ax_n - Bv_n)$$

to within a saturation region of the LCD pixel corresponding to pixel values between 0 and 255; and rounding the clamped ideal pixel strength to yield the overdrive pixel value.

7. A method as recited in claim 6, further comprising:

using the overdrive pixel value to update the current pixel value $x_n$ and the current pixel velocity value $v_n$ from a current frame to a next frame.

8. Computer readable medium encoded with computer program product executable by a processor for providing a liquid crystal display (LCD) pixel response time corresponding to a period of time required for a selected LCD pixel at a starting pixel value to reach a target pixel value associated with an overdrive pixel value in an LCD panel having a number of LCD pixels, comprising:

computer code for modeling response of each of the LCD pixels as a second order dynamical system represented as a second order differential equation ($m\ddot{x}+kv+x=p$) wherein x, v and p represent an LCD pixel value, an associated change in pixel value with respect to time, and an applied LCD pixel voltage, respectively, and wherein m and k represent an LCD pixel mass and associated pixel damping factor, respectively;

computer code for calculating LCD pixel response data of the selected pixel under the influence of an applied voltage p based upon the second order differential equation when the selected LCD pixel has an initial LCD pixel value of $x_0$ and an associated pixel velocity value of $v_0$;

computer code for determining a best fit (m, k) pair value, wherein the best fit (m,k) values are those values of m and k that result in a calculated LCD pixel response that most-nearly matches a measured LCD pixel response for the LCD panel; and calculating $\alpha_1$ and $\alpha_2$ based upon the best fit (m, k) pair value, wherein $$\alpha_1 = \frac{-k + \sqrt{k^2 - 4m}}{2m}, \quad \alpha_2 = \frac{-k - \sqrt{k^2 - 4m}}{2m},$$

wherein $\alpha_1$ and $\alpha_2$ are roots of the second order differential equation $m\ddot{x}+kv+x=p$ that models the LCD pixel response.

9. Computer readable medium encoded with computer program product as recited in claim 8, further comprising:

calculating a set of runtime coefficients {A, B, C, D, E, F} as $$\begin{cases} A = \dfrac{\alpha_2 e^{\alpha_1} - \alpha_1 e^{\alpha_2}}{\alpha_2 - \alpha_1} \\ B = \dfrac{-e^{\alpha_1} + e^{\alpha_2}}{\alpha_2 - \alpha_1} \\ C = \dfrac{-\alpha_2 e^{\alpha_1} + \alpha_1 e^{\alpha_2}}{\alpha_2 - \alpha_1} + 1 \\ D = \dfrac{\alpha_1 \alpha_2}{\alpha_2 - \alpha_1}(e^{\alpha_1} - e^{\alpha_2}) \\ E = \dfrac{-\alpha_1 e^{\alpha_1} + \alpha_2 e^{\alpha_2}}{\alpha_2 - \alpha_1} \\ F = \dfrac{\alpha_1 \alpha_2}{\alpha_2 - \alpha_1}(-e^{\alpha_1} + e^{\alpha_2}) \end{cases}$$

wherein the runtime coefficients {A, B, C, D, E, F} are constants used to compute a next pixel value $x_{n+1}$ from a current pixel value $x_n$ and to compute a next pixel velocity value $v_{n+1}$ from a current pixel velocity value $v_n$.

10. Computer readable medium encoded with computer program product as recited in claim 9, further comprising:

computing the next pixel value $x_{n+1}$ and the next pixel velocity value $v_{n+1}$ for a frame n+1

$$\text{wherein} \begin{cases} x_{n+1} = A \times x_n + B \times v_n + C \times p \\ v_{n+1} = D \times x_n + E \times v_n + F \times p \end{cases}.$$

11. Computer readable medium encoded with computer program product as recited in claim 10 comprising:

assuming an initialstate with $x_0$ and $v_0$ both equal to 0.

12. Computer readable medium encoded with computer program product as recited in claim 11 wherein based upon the assuming, calculating an ideal pixel strength $$p_{ideal} = \frac{1}{C}(p_{n+1} - A \times x_n - B \times v_n).$$

13. Computer readable medium encoded with computer program product as recited in claim 12 comprising:

clamping the ideal pixel strength $$p_{ideal} = \frac{1}{C}(p_{n+1} - A \times x_n - B \times v_n)$$

to within a saturation region of the LCD pixel corresponding to pixel values between 0 and 255; and rounding the clamped ideal pixel strength to yield the overdrive pixel value.

14. Computer readable medium encoded with computer program product as recited in claim 13, further comprising:

using the overdrive pixel value to update the current pixel value $x_n$ and the current pixel velocity value $v_n$ from a current frame to a next frame.

* * * * *

UNITED STATES PATENT AND TRADEMARK OFFICE

CERTIFICATE OF CORRECTION

PATENT NO. : 7,348,950 B2
APPLICATION NO. : 10/985688
DATED : March 25, 2008
INVENTOR(S) : M. Halfant It is certified that error appears in the above-identified patent and that said Letters Patent is hereby corrected as shown below:

| COLUMN | LINE | |
|---|---|---|
| 12 (Claim 3, line 4) | 10 | $\begin{cases} x_{n+1} = Ax_n + Bv_n + Cp \\ v_{n+1} = Dx_n + Ev_n + Fp \end{cases}$ should read $\begin{cases} x_{n+1} = A \times x_n + B \times v_n + C \times p \\ v_{n+1} = D \times x_n + E \times v_n + F \times p \end{cases}$ |
| 14 (Claim 11, line 3) | 9 | "initialstate" should read --initial state-- |

Signed and Sealed this
Fifth Day of April, 2011

David J. Kappos

David J. Kappos
*Director of the United States Patent and Trademark Office*